United States Patent [19]

Williams et al.

[11] Patent Number: 5,065,602

[45] Date of Patent: Nov. 19, 1991

[54] LOCKABLE CONTAINER FOR SECURING VALUABLES

[75] Inventors: George W. Williams, Nanticoke; Arnold S. Rifkin, Wilkes-Barre, both of Pa.

[73] Assignee: A. Rifkin Co., Wilkes-Barre, Pa.

[21] Appl. No.: 642,960

[22] Filed: Jan. 18, 1991

[51] Int. Cl.[5] ..... E05B 67/38

[52] U.S. Cl. ..... 70/68; 24/436; 190/903; 383/5; 383/97

[58] Field of Search ..... 70/68; 383/5, 97; 190/120, 903; 24/436

[56] References Cited

U.S. PATENT DOCUMENTS

| | | | |
|---|---|---|---|
| 1,950,414 | 3/1934 | Rifkin | 70/2 |
| 1,950,415 | 3/1934 | Rifkin | 70/2 |
| 3,070,986 | 1/1963 | Hart | 70/68 |
| 3,653,236 | 4/1972 | Kerr | 70/68 |
| 3,759,073 | 9/1973 | Rifkin | 70/68 |
| 4,249,402 | 2/1981 | Steinbach | 70/68 |
| 4,685,315 | 8/1987 | Comolli | 190/903 X |
| 5,013,162 | 5/1991 | Williams et al. | 70/68 X |

*Primary Examiner*—Lloyd A. Gall

*Attorney, Agent, or Firm*—Panitch Schwarze Jacobs & Nadel

[57] ABSTRACT

A flexible-wall lockable container for securing valuables. The lockable container includes a container and a locking member. The container includes an interior portion, an access opening, and a closure member. The closure member has an open position permitting access to the interior portion of the container, and a closed position where the closure member closes the access opening. The locking member includes a body and a retainer member slidably attached to the body. The retainer member has a locked position with respect to the body for locking the closure member in the closed position and an unlocked position for allowing the closure member to move between the closed and open positions. The body includes a receiver having two lower lugs extending from the receiver. The retainer member includes a flange having two upper lugs extending from the flange. When the retainer member is in the locked position, a portion of the closure member is positioned between the sides of the lugs to inhibit the portion of the closure member from moving with respect to the upper and lower lugs.

6 Claims, 2 Drawing Sheets

LOCKABLE CONTAINER FOR SECURING VALUABLES

FIELD OF THE INVENTION

The invention relates to flexible-wall lockable containers and, more particularly, to assuring the secured integrity of such containers.

BACKGROUND OF THE INVENTION

Banks typically provide customers with flexible-wall lockable containers (i.e., deposit bags) for allowing the customers to make deposits both during and after normal banking hours. Each bag has a keeper lock for securably receiving the slide of a zipper.

Lockable deposit bags are generally known in the art. One type of lockable deposit bag includes a zipper and keeper lock. The keeper lock includes a body and a retainer or bolt slidably mounted on the body. A receiver member extends from the body in the direction of the zipper. The receiver member has a recess which conforms to the general shape of the slide on the zipper. A flange extends from the retainer and has a recess on the lower surface thereof which conforms to the general shape of the slider member. When the keeper lock is in the locked position, the slide is clamped between the recesses of the receiver member and the flange to thereby inhibit movement of the slide.

On the previous model, when the locking member is in the closed position, a gap existed between the retainer member, the flange, and the inner end surface of the body. The gap may have been of sufficient magnitude that, through the exercise of great manual dexterity and skill, the integrity of the bag might have been comprised. It would serve no useful purpose to provide a detailed explanation here concerning the precise manner in which the bag might be compromised.

The present invention overcomes the disadvantages inherent in the prior art by providing cooperating upper lugs on the lower surface of the flange. The advantage of the upper lugs is two-fold. First, the upper lugs fill the gaps between lower lugs on the receiver and the inner end surface of the retainer body to limit access to the interior area of the locking mechanism and protect the slide. Second, the tape and/or teeth of the zipper are secured between the upper and lower lugs to promote the secured integrity of the container. Therefore, the present invention efficiently and effectively overcomes the problems inherent in the prior art.

SUMMARY OF THE INVENTION

Briefly stated, the present invention comprises a lockable container for securing valuables. The lockable container comprises a container and a locking member. The container includes an interior portion, access opening and a closure member positioned thereon. The closure member has an open position for allowing access to the interior portion of the container through the access opening and a closed position where the closure member closes the access opening such that the interior of the container is not accessible. The locking member is positioned on the container proximate the closure member. The locking member is comprised of a body and a retainer member slidably attached to the body generally exteriorly of the container. The retainer member has a locked position with respect to the body for locking the closure member in the closed position and an unlocked position for allowing the closure member to move between the closed and open positions. The body includes a receiver extending from an inner end surface of the body along the access opening. The receiver has an upper surface including at least two lower lugs extending generally upward from the upper surface of the receiver. Each lower lug has a lower lug side extending generally perpendicular to the receiver. The lower lugs are spaced from the inner end surface of the body whereby at least two gaps are formed between the inner end surface of the body and the lower lug side of the lower lugs. The retainer member includes a flange extending from an inner end surface of the retainer member along the access opening. The flange has a lower surface which extends generally parallel to the upper surface of the receiver and at least two upper lugs extending generally downward from the lower surface of the flange member toward the receiver. Each upper lug has an upper lug side extending generally perpendicular to the flange. The upper lugs are correspondingly positioned within the gaps when the retainer member is in the locked position such that the lower lug sides of the lower lugs are correspondingly positioned adjacent to the upper lug sides of the upper lugs with a portion of the closure member positioned therebetween to thereby inhibit the portion of the closure member from moving with respect thereto.

BRIEF DESCRIPTION OF THE DRAWINGS

The foregoing summary, as well as the following detailed description of the preferred embodiment, will be better understood when read in conjunction with the appended drawings. For the purpose of illustrating the invention, there is shown in the drawings an embodiment which is presently preferred, it being understood, however, that the invention is not limited to the specific methods and instrumentalities disclosed. In the drawings.

DESCRIPTION OF THE PREFERRED EMBODIMENT

Figure 1:
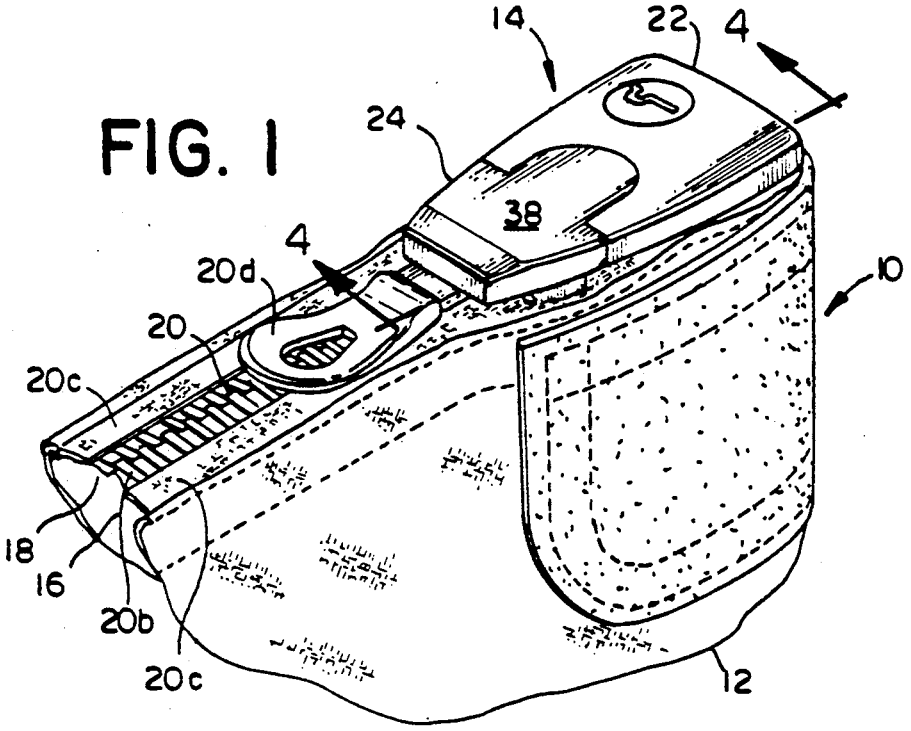
FIG. 1 is a partial perspective view of a locking member of a lockable container with the locking member in the locked position in accordance with the present invention.

Certain terminology is used in the following description for convenience only and is not limiting. The words "right," "left," "lower," and "upper" designate directions in the drawings to which reference is made. The terminology includes the words above specifically mentioned, derivatives thereof, and words of similar import.

Referring to the drawings, wherein like numerals indicate like elements throughout, there is shown in FIGS. 1 through 4 a preferred embodiment of a lockable container, generally designated 10, for securing valuables (not shown).

Referring now to FIG. 1, the lockable container 10 is preferably comprised of a container 12 and a locking member, generally designated 14. The container 12 includes an interior portion 16 for receiving the valuables. An access opening 18 and a closure member 20 are positioned on the container 12. The closure member 20 has an open position (see FIG. 3) for allowing access to the interior portion 16 of the container 12 through the access opening 18. The closure member 20 also includes a closed position (as shown in FIG. 1) where the closure member 20 closes the access opening 18 such that the interior portion 16 of the container 12 is not accessible.

In the present embodiment, the lockable container 10 is preferably a flexible-wall bank deposit bag, as is well known to those skilled in the art. More particularly, it is preferred that the container 12 be formed of a singular generally rectangular sheet of canvas, as disclosed in U.S. Pat. No. 3,653,236, which is hereby incorporated by reference. However, it is understood by those skilled in the art that the present invention is applicable to a wide variety of containers which employ locking members and closure members for their closure. Examples of such containers are duffel bags, travelling cases, and other flexible-wall containers too numerous to mention.

Figure 2:
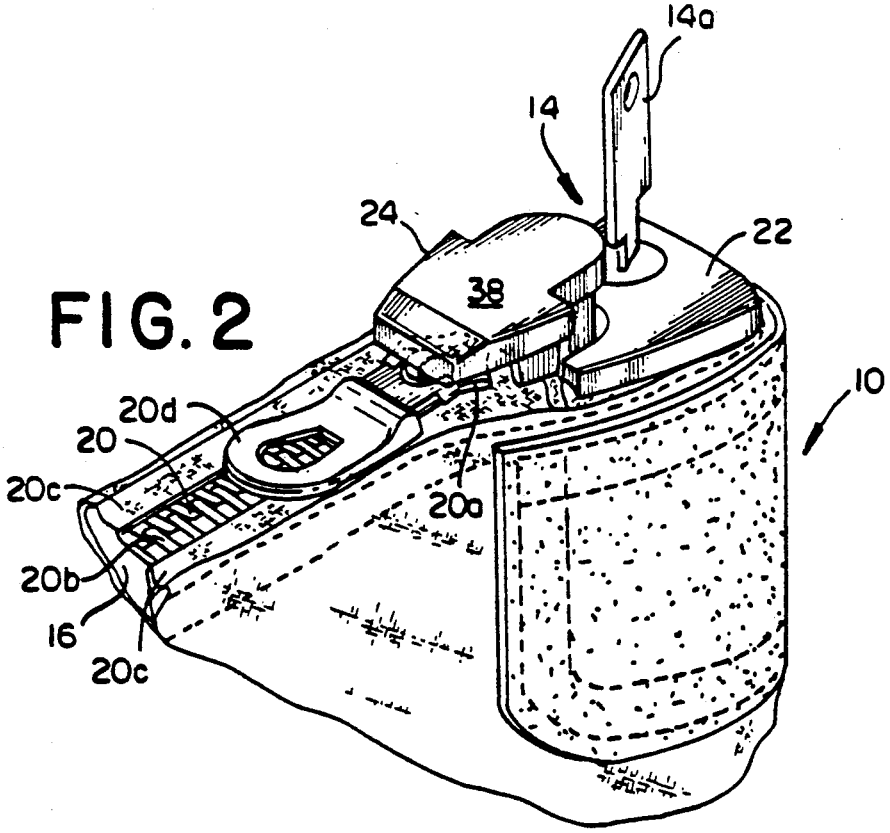
FIG. 2 is a partial perspective view of the locking member and lockable container of FIG. 1 showing the locking member in the unlocked position.

In the presently preferred embodiment, the closure member 20 is a slide fastener of the so-called zipper type. As shown in FIG. 2, the closure member 20 includes a slide 20*a*, teeth 20*b*, tape 20*c*, and a tab 20*d* as is understood by those skilled in the art. It is similarly understood by those skilled in the art that other means can be used for opening and closing the container 12, such as a toothless plastic slide fastener.

In the presently preferred embodiment, the locking member 14 is positioned on the container 12 proximate the closure member 20. Specifically, it is preferred that the locking member 14 be positioned on the container 12 for receiving the slide 20*a* of the closure member 20 when the closure member 20 is in the closed position.

Figure 3:
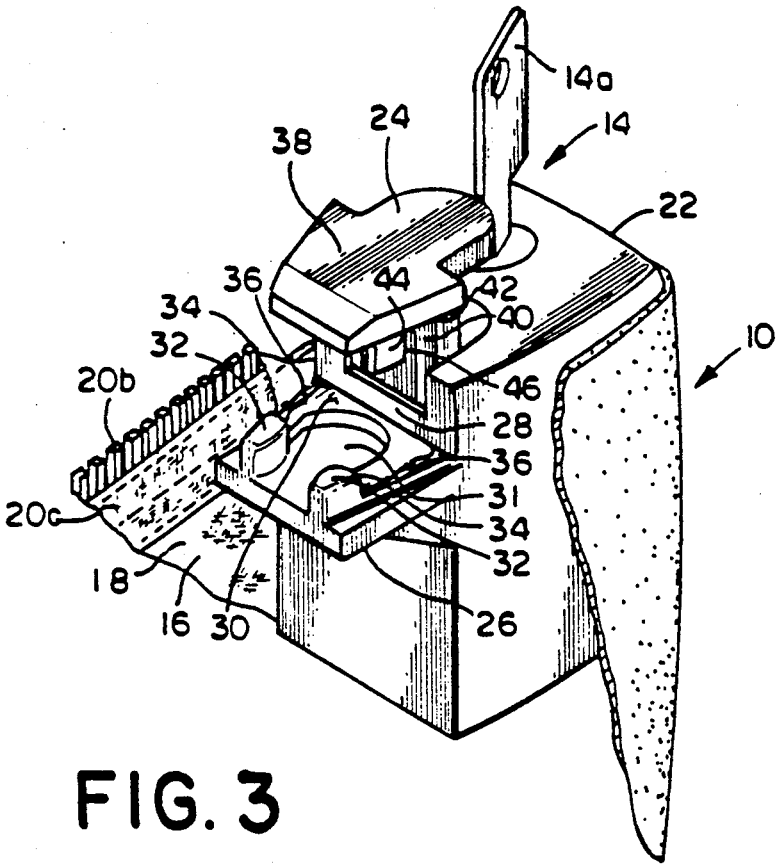
FIG. 3 is a partial perspective view, partially broken-away, of the locking member of FIG. 2 in the unlocked position.

As best shown in FIG. 3, the locking member 14 is comprised of a body 22 and a retainer member 24 or bolt slidably attached to the body 22 generally exteriorly to the container 12. The retainer member 24 has a locked position (as shown in FIG. 1) with respect to the body 22 for locking the closure member 20 in the closed position (shown in FIGS. 1 and 4) and an unlocked position (shown in FIGS. 2 and 3) for allowing the closure member 20 to move between the closed and open positions.

In the presently preferred embodiment, the looking member 14 is preferably a key-operated keeper lock having a key 14*a*. An example of such a locking member is disclosed in U.S. Pat. No. 3,653,236. However, it is understood by those skilled in the art that other locks or keeper locks could be used in connection with the present invention, such as a combination-type keeper lock.

In the present embodiment, it is preferred that the locking member 14 be formed from a lightweigh: high strength metallic material, such as a zinc alloy. It is understood by those skilled in the art that other materials may be used for the locking member, such as brass, aluminum, and polymer(s).

Referring now to FIG. 3, the body 22 includes a generally planar receiver 26 which extends from an inner end surface 28 of the body 22 along the access opening 18. In the present embodiment it is preferred that the receiver 26 extend generally perpendicularly from the inner end surface 28. However, it is understood by those skilled in the art that the receiver 26 can extend from the inner end surface 28 at any angle, without departing from the spirit and scope of the invention.

The receiver 26 has an upper surface 30 which includes a recess 31 which corresponds to the shape of the slide 20*a*. The receiver 26 also has at least two lower lugs 32 extending generally upward from the upper surface 30 of the receiver 26. Each lower lug 32 has a lower lug side 34 extending generally perpendicular to the upper surface 30 of the receiver 26. The lower lugs 32 are spaced from the inner end surface 28 of the body 22 whereby at least two gaps 36 are formed between the inner end surface 28 of the body 22 and each lower lug side 34 of the lower lugs 32.

Referring now to FIG. 3, the retainer member 24 includes a flange 38 extending from an inner end surface 40 of the retainer member 24 along the access opening 18. The flange 38 has a lower surface 42 which extends generally parallel to the upper surface 30 of the receiver 26. The length of the lower surface 42 of the flange 38 corresponds to the length of the receiver 26.

Figure 4:
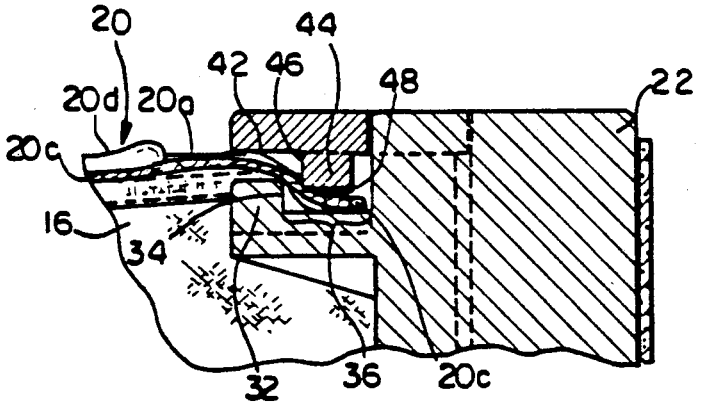
FIG. 4 is a cross sectional view of the locking member and lockable container of FIG. 1 taken along line 4—4 of FIG. 1.

FIG. 4 shows the locking member 14 in the locked position with the zipper 20 positioned away from the locking member 14 in order to more clearly show the position of the tape 20*c* when the locking member 14 is in the locked position. Referring to FIGS. 3 and 4, the length of the lower surface 42 of the flange 38 and receiver 26 is such that when the retainer member 24 is in the locked position the tab 20*d* is forced downwardly into contact with the teeth 20*b*. Therefore, the tab 20*d* cannot be lifted upwardly to release the auto-locking feature incorporated in standard zippers thereby preventing the teeth 20*b* and tape 20*c* from moving with respect to the slide 20*a*, as is understood by those skilled in the art. The lower surface 42 of the flange 38 preferably includes a flange recess (not shown) which corresponds to the shape of the slide 20*a* and at least two upper lugs 44 extending generally downward from the lower surface 42 of the flange 38 towards the receiver 26. Each upper lug 44 has an upper lug side 46 extending generally perpendicular to the flange 38. In the present embodiment, it is preferred that a gap exist between the lower lugs 32 and the lower surface 42 of the flange 38 and between the upper lugs 44 and the upper surface 30 of the receiver 26 for receiving the tape 20*c* when the retainer member 24 is in the locked position, as best shown in FIG. 4. Furthermore, it is preferred that the gap between the upper lugs 44 and the inner end surface 28 of the body 22 as well as the gap between the upper lugs 44 and the upper surface 30 be such that the teeth 20*b* cannot fit therebetween to further enhance the integrity of the lockable container 10.

In the present embodiment, it is preferred that the retainer member 24 be formed of a casting process and that the upper lugs 44 be formed on the flange 38 during the casting process. However, it is understood by those skilled in the art that the upper lugs 44 may be formed by other means. For instance, the upper lugs 44 could be welded to the retainer member 24 without departing from the spirit and scope of the invention.

In use, the closure member 20 is placed in the open position and valuables (not shown) are introduced through the access opening 18 into the interior portion 16 of the container 12. The closure member 20 is then moved to the closed position such that the slide 20*a* is located within the recess 31 of the receiver 26. A downward force is then applied to the retainer member 24 until it reaches its locked position. When the retainer member 24 is in the locked position, the upper lugs 44 are correspondingly positioned within the gaps 36 such that the lower lug sides 34 are proximate the upper lug sides 46 with a portion (i.e., tape 20*c*) of the closure member 20 positioned therebetween to inhibit the tape 20*c* from moving with respect thereto. Furthermore, the gap between the upper lugs 44 and the upper surface 30 and the gap between the upper lugs 44 and the inner end surface 28 of the body 22 are sized such that the zipper teeth 20*b* cannot pass therethrough. Accordingly, the lockable container 10 in accordance with the present invention is highly effective in inhibiting the tape 20*c* and teeth 20*b* from being slid forward through the slide 20*a* to gain access to the interior portion 16 of the container 12.

From the foregoing description, it can be seen that the present invention comprises a very secure lockable container for holding valuables. It will be appreciated by those skilled in the art that changes could be made to the embodiment described above without departing from the broad inventive concept thereof. It is understood, therefore, that this invention is not limited to the particular embodiment disclosed, but it is intended to cover all modifications which are within the spirit and scope of the invention as defined by the appended claims.

We claim:

1. A lockable container for securing valuables comprising:

a container including an interior portion, said container having an access opening and a closure member positioned thereon, said closure member having an open position for allowing access to said interior portion of said container through said access opening and a closed position where said closure member closes said access opening such that said interior of said container is not accessible; and a locking member positioned on said container proximate said closure member, said locking member comprising a body and a retainer member slidably attached to said body generally exteriorly to the container, said retainer member having a locked position with respect to said body for locking said closure member in said closed position and an unlocked position for allowing said closure member to move between said closed and open positions, said body including a receiver extending from an inner end surface of said body along said access opening, said receiver having an upper surface including at least two lower lugs extending generally upward from the upper surface of the receiver, each lower lug having a lower lug side extending generally perpendicular to said receiver, said lower lugs being spaced from the inner end surface of said body whereby at least two gaps are formed between said inner end surface of said body and said lower lug side of said lower lugs, said retainer member including a flange extending from an inner end surface of said retainer member along said access opening, said flange having a lower surface generally parallel to the upper surface of the receiver and at least two upper lugs extending generally downward from the lower surface of said flange member towards said receiver, each upper lug having an upper lug side extending generally perpendicular to said flange, said upper lugs being correspondingly positioned within said gaps when said retainer member is in said locked position such that said lower lug sides of said lower lugs are correspondingly positioned adjacent said upper lug sides of said upper lugs with a portion of said closure member positioned therebetween to thereby inhibit said portion of said closure member from moving with respect thereto.

2. The lockable container according to claim 1, wherein said receiver and said flange extend generally parallel with respect to each other.

3. The lockable container according to claim 1, wherein said upper lugs are complementarily positioned within said gaps when said retainer member is in said locked position.

4. The lockable container according to claim 3, wherein said closure member is comprised of tape including teeth, a slide for engaging and disengaging said teeth, and a tab for facilitating action of said slide.

5. The lockable container according to claim 4, wherein gaps are formed between said upper lugs and said upper surface and gaps are formed between said upper lugs and said inner end surface of said body, said gaps between said upper lugs and said upper surface and said gaps between said upper lugs and said inner end surface being sized to inhibit said teeth from passing therebetween.

6. A locking member for a container including an interior portion, the container having an access opening and a closure member positioned thereon, said closure member having an open position for allowing access to said interior portion of said container through said access opening and a closed position where the closure member closes said access opening such that said interior of said container is not accessible, said locking member comprising:

a body and retainer member slidably attached to said body, said retainer member having a locked position with respect to said body for locking said container in said closed position and an unlocked position, said body including a receiver extending from an inner end surface of said body along said access opening, said receiver having an upper surface including at least two lower lugs extending generally upward from the upper surface of the receiver, each lower lug having a lower lug side extending generally perpendicular to said receiver, said lower lugs being spaced from the inner end surface of said body whereby at least two gaps are formed between said inner end surface of said body and said lower lug side of said lower lugs, said retainer member including a flange extending from an inner end surface of said retainer member along said access opening, said flange having a lower surface generally parallel to the upper surface of the receiver and at least two upper lugs extending generally downward from the lower surface of said flange towards said receiver, each upper lug having an upper lug side extending generally perpendicular to said flange, said upper lugs being correspondingly positioned within said gaps when said retainer member is in said locked position such that said lower lug sides of said lower lugs are correspondingly positioned adjacent said upper lug sides of said upper lugs with a portion of said closure member positioned therebetween to thereby inhibit said portion of said closure member from moving with respect thereto.

* * * * *